US007206538B2

(12) United States Patent
Kumar et al.

(10) Patent No.: US 7,206,538 B2
(45) Date of Patent: Apr. 17, 2007

(54) XEROGRAPHIC DEVELOPER UNIT WITH SPECIALIZED EXIT PORT FOR DEVELOPER MATERIAL

(75) Inventors: Ajay Kumar, Fairport, NY (US); Jonathan D. Sadik, Rochester, NY (US); Keith A. Nau, Webster, NY (US); David A. Reed, Rochester, NY (US); Richard L. Kjar, Canandaigua, NY (US)

(73) Assignee: Xerox Corporation, Stamford, CT (US)

( * ) Notice: Subject to any disclaimer, the term of this patent is extended or adjusted under 35 U.S.C. 154(b) by 214 days.

(21) Appl. No.: 11/093,124

(22) Filed: Mar. 29, 2005

(65) Prior Publication Data

US 2006/0222411 A1 Oct. 5, 2006

(51) Int. Cl.
*G03G 15/08* (2006.01)

(52) U.S. Cl. ..... 399/257

(58) Field of Classification Search ..... 399/257, 399/252, 258, 8

See application file for complete search history.

(56) References Cited

U.S. PATENT DOCUMENTS 4,614,165 A 9/1986 Folkins et al.
4,850,303 A * 7/1989 Cipolla et al. ..... 399/257
4,913,087 A 4/1990 Saita et al.
5,250,749 A * 10/1993 Aimoto ..... 399/257
5,436,703 A 7/1995 DeYoung et al.
5,734,952 A * 3/1998 Murakami et al. ..... 399/258
6,332,065 B1 * 12/2001 Howard ..... 399/258
6,353,722 B1 3/2002 Klimley et al.
6,587,661 B1 7/2003 Shimmura et al.
6,920,301 B2 * 7/2005 Arimoto ..... 399/257
2004/0228639 A1 * 11/2004 Badovinac et al. ..... 399/8
2005/0150403 A1 * 7/2005 Kidaka
2005/0175366 A1 * 8/2005 Hasegawa et al.
2005/0175376 A1 * 8/2005 Sekiguchi ..... 399/258
2005/0226655 A1 * 10/2005 Katsuyama et al. ..... 399/258

* cited by examiner

*Primary Examiner*—Susan Lee
(74) *Attorney, Agent, or Firm*—R. Hutter

(57) ABSTRACT

In a basic design of a developer unit for electrostatographic printing apparatus, an exit port is defined in the housing of the developer unit, for the passage of waste or surplus toner therethrough. An insert, defining a predetermined spillover barrier height and a predetermined exit angle, is associated with the exit port. Different types of inserts can be provided for operating the basic design of developer unit at different print output speeds, or with different compositions of developer material.

17 Claims, 4 Drawing Sheets

XEROGRAPHIC DEVELOPER UNIT WITH SPECIALIZED EXIT PORT FOR DEVELOPER MATERIAL

TECHNICAL FIELD

The present disclosure relates generally to an electrostatographic or xerographic printing machine, and more particularly concerns an exit port for collecting and disposing of waste developer material.

BACKGROUND

In the process of electrophotographic printing, a charge-retentive surface, also known as a photoreceptor, is charged to a substantially uniform potential, so as to sensitize the surface of the photoreceptor. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed image on the photoreceptor is subsequently transferred to a sheet on which the desired image is to be printed. Finally, the toner on the sheet is heated to permanently fuse the toner image to the sheet.

One familiar type of development of an electrostatic image is called "two-component development". Two-component developer material largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere to the electrostatic latent image.

U.S. Pat. No. 4,614,165, assigned to the assignee hereof, discloses the general principle of what is known familiarly as "trickle" development. Very briefly, trickle development involves providing two distinct supplies of developer: a main supply, from which the developer unit draws developer for application to the electrostatic latent image, and a second, separate developer supply which is used to replenish the first supply over time. Typically, the two quantities of developer have substantially different ratios of toner to carrier. Over time, the relatively toner-rich developer in the second supply is gradually discharged, or caused to "trickle", into the first developer supply. This trickling provides a substantially continuous replenishment of toner rich developer, and thereby maintains the effective ratio of toner to carrier within the main developer supply within an optimal range.

In a trickle development system, as a fresh supply of developer is discharged into the housing of the developer unit, it is typically necessary that a similar quantity of surplus developer be discharged from the housing of the developer unit. This surplus or waste material is commonly collected in a waste bottle. An auger contained in a transport tube is often used to transport the waste material through the tube to the waste bottle. The transport tube, with the auger therein, typically extends through a seal in an opening in the waste bottle. Waste material traveling through the transport tube is discharged into the waste bottle through an opening in the tube.

U.S. Pat. No. 5,436,703 shows a trickle development system in which a special spillover barrier is provided at the port from which waste developer material is ejected from the development housing. The barrier defines a predetermined height relative to the developer level to ensure proper maintenance of the desired toner to carrier ratio. U.S. Pat. No. 6,353,722 describes a type of trickle exit port having an auger.

The present disclosure generally relates to an exit port configuration that facilitates a basic design of developer unit being readily adaptable for operating at different speeds.

SUMMARY

According to one aspect, there is provided an electrostatographic printing apparatus, comprising a developer housing, for retaining a quantity of developer material; an exit port defined in the developer housing for passage of developer material out of the developer housing; and an insert associated with the exit port, the insert defining at least one of a predetermined barrier height and a predetermined exit surface angle for developer material passing through the exit port.

According to another aspect, there is a method of providing a first printing apparatus and a second printing apparatus, the first printing apparatus having a first developer unit and the second printing apparatus having a second developer unit, the first developer unit and the second developer unit having a substantially similar design and each defining an exit port for passage of developer material therefrom, comprising: installing in the first developer unit an insert of a first type, the insert of the first type defining at least one of a first predetermined barrier height and a first predetermined exit surface angle for developer material passing through the exit port thereof; and installing in the second developer unit an insert of a second type, the insert of the second type defining at least one of a second predetermined barrier height and a second predetermined exit surface angle for developer material passing through the exit port thereof.

According to another aspect, there is provided an insert suitable for associating with an exit port defined in a developer unit of an electrostatographic printer, the insert defining at least one of a predetermined barrier height and a predetermined exit surface angle for developer material passing through the exit port.

DETAILED DESCRIPTION

Figure 1:
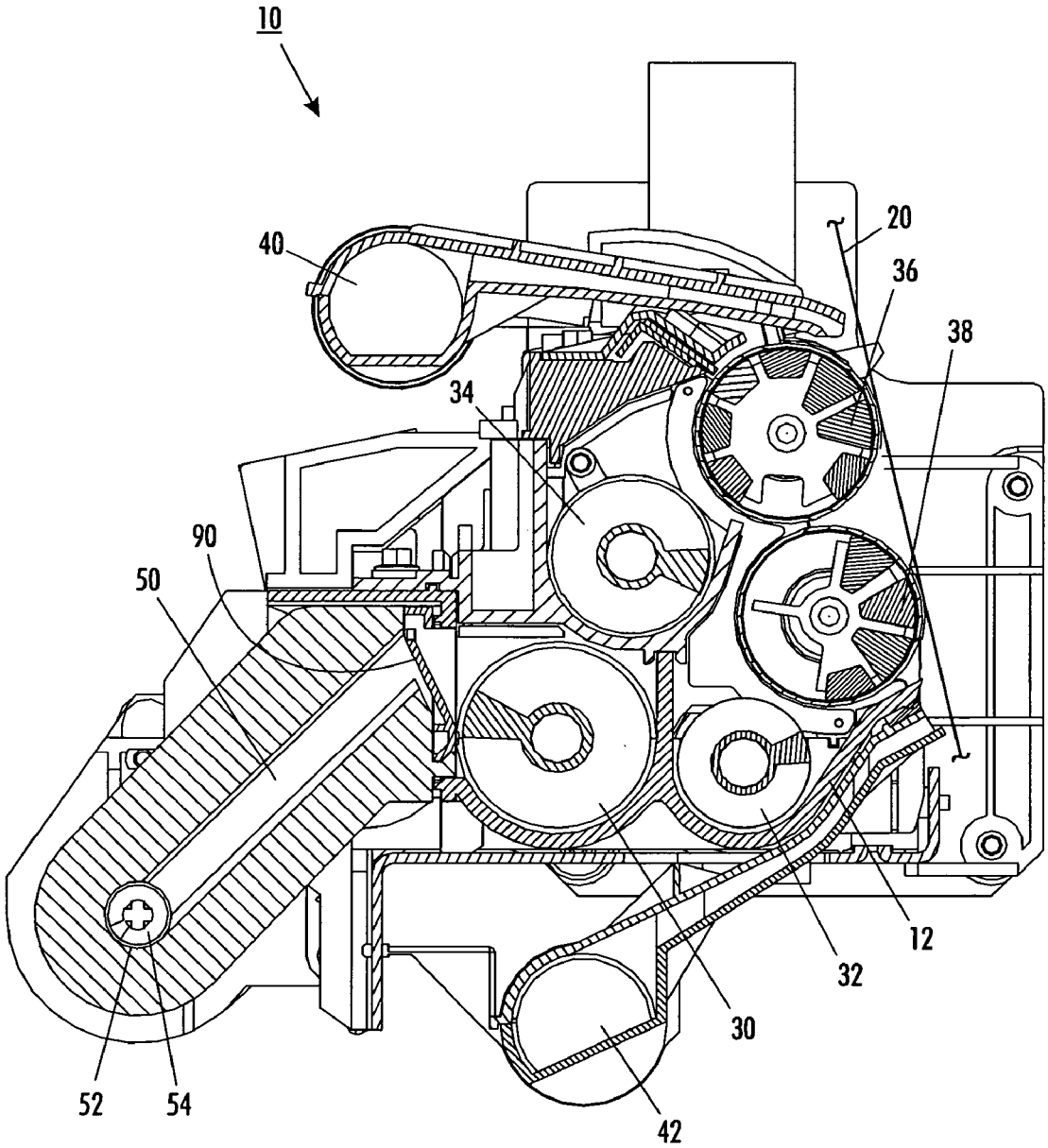
FIG. 1 is a sectional elevational view of a developer unit, as would be found in an electrostatographic printing apparatus.

FIG. 1 is a sectional elevational view of a developer unit 10, as would be found in an electrostatographic printing apparatus, such as a printer or copier. The overall function of developer unit 10 is to apply marking material, such as toner, onto suitably-charged areas forming a latent image on an image receptor such as photoreceptor 20 (a portion of which is shown), in a manner generally known in the art. In various types of printers, there may be multiple such developer units 10, such as one for each primary color or other purpose.

Among the elements of a the developer unit 10 shown in FIG. 1, which are typical of developer units of various types, are a housing 12, which functions generally to hold a supply of developer material, as well as augers such as 30, 32, 34, which variously mix and convey the developer material, and magnetic rolls 36, 38, which in this embodiment form magnetic brushes to apply developer material to the photoreceptor 20. Other types of features for development of latent images, such as donor rolls, paddles, scavengeless-development electrodes, commutators, etc., are known in the art and could be used in conjunction with various embodiments pursuant to the claims. In the illustrated embodiment, there is further provided air manifolds 40, 42, attached to vacuum sources (not shown) for removing dirt and excess particles from the transfer zone near photoreceptor 20. As mentioned above, in many embodiments of developer unit, a two-component developer material is used, comprising toner and carrier; the carrier particles are generally not applied to the photoreceptor 20, but rather remain circulating within housing 12.

In "trickle" type development systems as described above, but also in other types of developer unit, there is provided what can be called an "exit port", here indicated as 90, for the exit of excess or waste developer material from housing 12 for various reasons, such as to maintain a desired toner-to-carrier ratio or sump mass level. In the present embodiment, the exit port 90 is disposed near an auger 30, and communicates with an exit tube 50 which conveys waste developer to an output tube 52 which in turn includes a conveying auger 54 to convey, in this embodiment, the waste toner to a waste receptacle (not shown).

Figure 2:
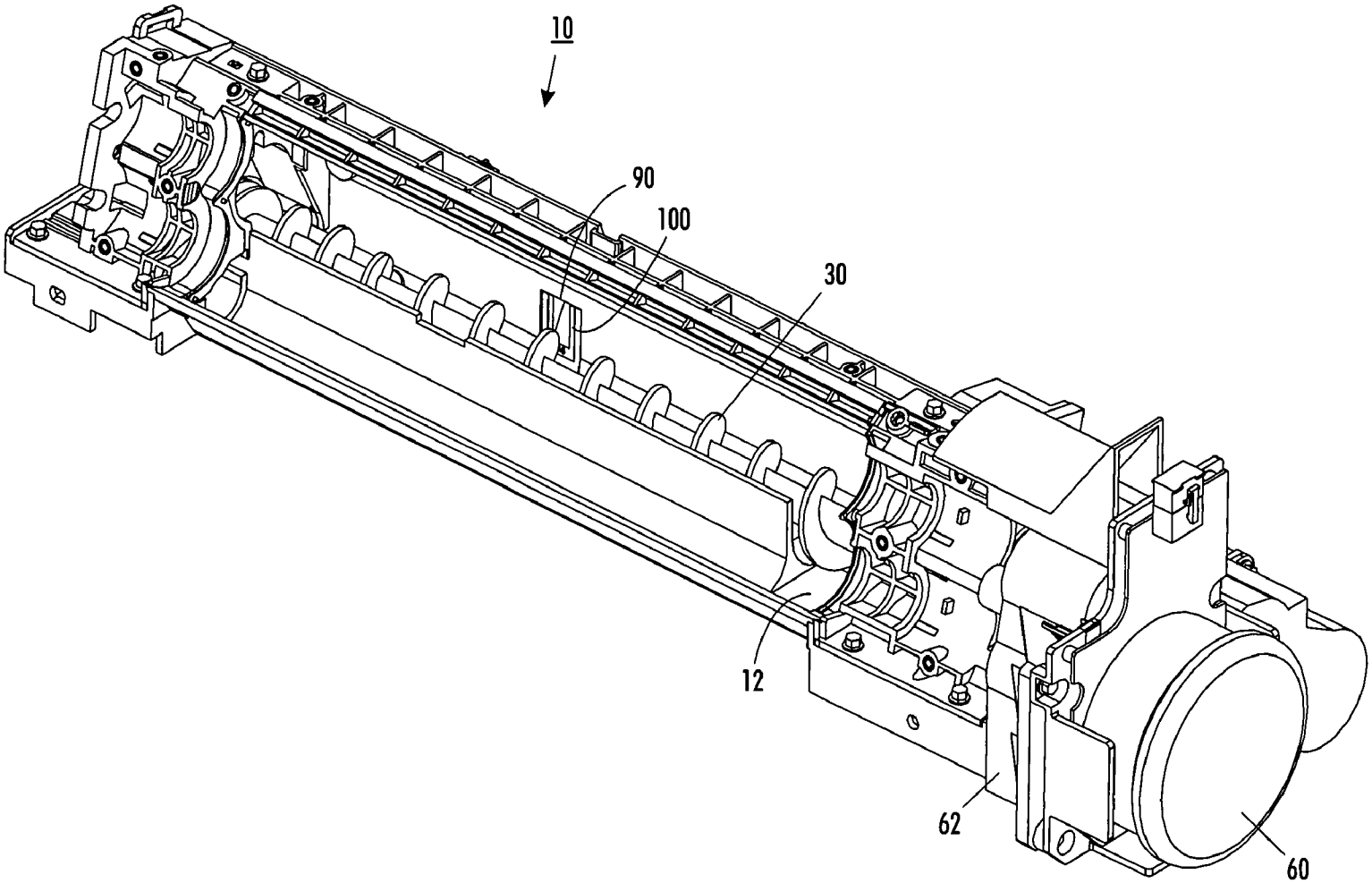
FIG. 2 is a perspective view of a portion of a developer unit.

FIG. 2 is a perspective view of a portion of developer unit 10. As can be seen, in this embodiment the exit port 90 in housing 12 is disposed adjacent auger 30 at a location along the length thereof. As further can be seen, a motor 60 is used with a mechanism generally indicated as 62 to cause rotation of the various augers, magnetic rolls, and any other rotatable members within the developer unit 10 at various relative velocities. There may be provided any number of such motors.

The structure of the exit port 90 forms a spillover barrier of a predetermined height between a local bottom of housing 12 and, in this embodiment, the exit tube 50. This effective height of the spillover barrier is an important parameter for maintaining a desirable toner-carrier ratio or sump mass in a trickle-type development system, or more generally to maintain a desirable toner or developer capacitance in any kind of development system, including single-component systems.

The effective height of exit port 90 must be selected with regard to, among other possible factors, the intended running speed, in pages per minute, of the printing apparatus. Typically, but not necessarily, operating a developer unit in accordance with a desired running speed involves rotating one or more of the various rotating members within the developer unit (augers, magnetic rolls, paddles, etc.) at predetermined speeds. Generally speaking, rotating a rotating member, such as auger 30 in the illustrated embodiment, at a particular rotational velocity will affect the amount of developer in the housing 12, which in some cases will affect the toner-to-carrier ratio of the developer. Therefore, the height and other attributes of the spillover barrier formed at exit port 90 will have an effect on the overall performance of the developer unit 10 when it is run at a given speed.

In the design of electrostatographic printing apparatus, it is desirable to have a basic design of the developer unit that can be placed in machines with various advertised operating speeds, such as 60 or 100 pages per minute. The attributes of the exit port 90 can therefore be customized to relatively improve performance of the basic developer unit design for a certain desired running speed.

Figure 3:
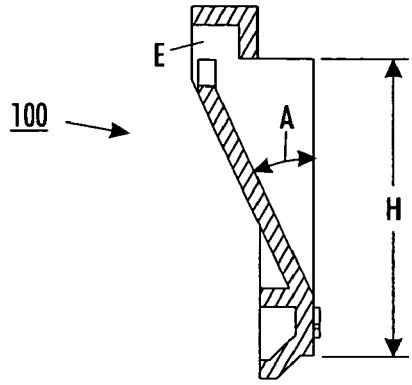
FIG. 3 is a sectional view of an insert in isolation.
Figure 4:
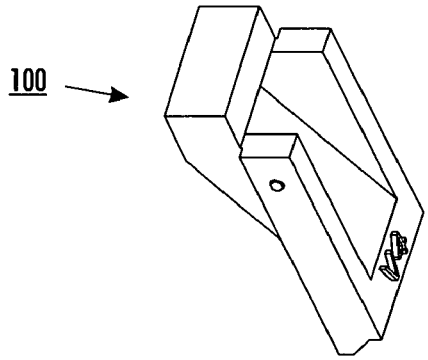
FIG. 4 is a perspective view of an insert in isolation.
Figure 5:
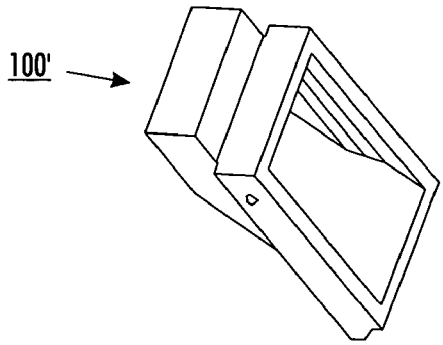
FIG. 5 is a perspective view of another type of insert in isolation.

As can be seen in FIG. 2, disposed in exit port 90 is an insert 100. FIG. 3 is a perspective view of insert 100 in isolation and FIG. 3 is a perspective view of insert 100 in isolation. As can be seen in FIG. 3, an insert 100 in this embodiment defines a spillover barrier height H and an exit surface angle A. The height H defines a spillover barrier height for a housing such as 12 in which the insert 100 is installed, and the exit surface angle A shall be broadly defined as any surface shape adjacent the spillover barrier on either side thereof (i.e., in various embodiments as desirable, the exit surface may define curves or multiple angles). FIG. 5 is a perspective view of another type of insert, indicated as 100', having different physical properties, which may be placed in exit port 90.

Figure 6:
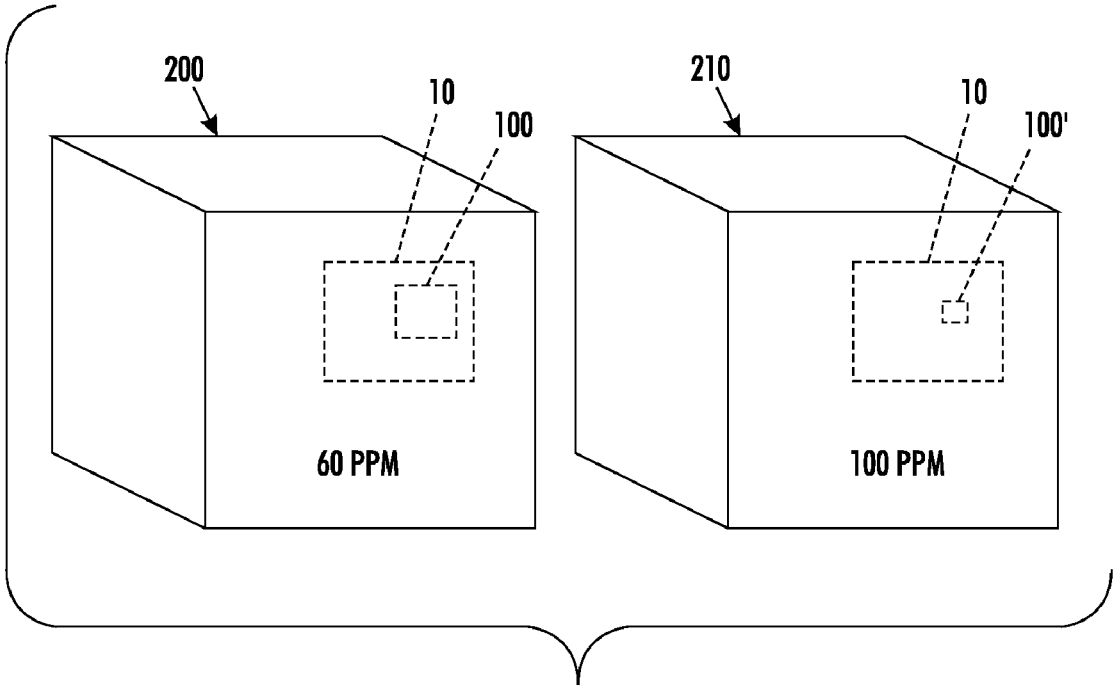
FIG. 6 is a simplified diagram of two substantially-identical printing machines.

In a practical application of such inserts 100, a type of insert 100 will define a spillover barrier height H and an exit surface angle A that is particularly suitable for a given operational speed of the developer unit 10. FIG. 6 shows two substantially identical printing machines 200 (rated speed 60 ppm) and 210 (rated speed 100 ppm. To operate a developer unit 10 at a selected speed, e.g., 100 pages per minute as in machine 210, an insert 100' is installed, which may define a different spillover barrier height H and/or an exit surface angle A than the insert 100 in machine 200. In this arrangement, the parts commonality between a developer unit 10 for machine 200 and a developer unit 10 for machine 210 is very high: indeed, the two types of developer unit 10 for different-speed printers 200 and 210 are substantially identical in design but for the insert 100 of a first type or a second type installed in each.

Use of inserts 100 of different configurations (height and/or exit angle) may also adapt a basic developer unit design to operate in a desirable way using different types of developer material. Among different types of developer material may be different compositions of toner and/or carrier; use of emulsion-aggregation or "chemical" toners versus ground toners; or even single-component versus two-component developers.

Another aspect of using a type of insert 100 for a particular purpose is that one type of insert or another may be shaped to accommodate the direction of rotation of an adjacent auger 30 or other rotating member within developer unit 10. In some families of printers, different models of printers may have an otherwise similar auger rotating in different directions. In practical embodiments of developer units, a developer cloud is created near the auger 30; this cloud can escape through the exit port 90 and thus affect the sump mass. Offsetting the port opening from the wall of developer housing 12, as shown by the angle A as well as the "elbowing" shape of the passage shown as E in FIG. 3, minimizes any effect of developer clouding and hence maintains better stability of the sump mass level.

The insert 100 may be installed in a developer unit 10 either by simple placement (i.e., the insert 100 has comparable dimensions as the surface of the housing 12 around exit port 90), may be attached by snap-fitting, an adhesive, or be kept in place by a screw or other fastener. An insert 100 may define a relatively large portion of the inner surface of housing 12, as compared to the illustrated embodiment. Although the illustrated embodiment of insert 100 is shaped to fully surround an exit port 90, such an attribute is not necessary.

Although, in the illustrated embodiment, exit port 90 is disposed generally at the middle along the length of auger 30, in other possible designs, exit port 90 may be disposed closer to one end of auger 30, or even in a sidewall at the end of auger 30.

As used herein, the term "printing apparatus" may refer to a developer unit installable in a printer; to a customer-replaceable unit installable in a printer, including or not including a photoreceptor 10 or a developer supply; to a printer itself; or to a printing module in a larger, multi-engine printer.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An insert suitable for associating with an exit port for passage of waste or excess developer material from a developer unit of an electrostatographic printer, the insert defining at least one of a predetermined spillover barrier height and a predetermined exit surface angle for developer material passing through the exit port, the insert further defining an elbowing passage.

2. The insert of claim 1, the insert being installable in the developer unit by at least one of placement, snap-fitting, an adhesive, and a fastener.

3. The insert of claim 1, the insert being shaped to fully surround an exit port.

4. An electrostatographic printing apparatus, comprising:

a developer housing, for retaining a quantity of developer material;

an exit port defined in the developer housing for passage of developer material out of the developer housing;

a rotatable member disposed within the developer housing, substantially adjacent the exit port; and an insert associated with the exit port, the insert defining at least one of a predetermined barrier height and a predetermined exit surface angle for developer material passing through the exit port.

5. The apparatus of claim 4, the insert being installed in the developer housing by at least one of placement, snap-fitting, an adhesive, and a fastener.

6. The apparatus of claim 4, wherein the rotatable member is an auger.

7. The apparatus of claim 4, the exit port being disposed near a middle of the rotatable member in the housing.

8. The apparatus of claim 4, further comprising a charge receptor defining a charge-retentive surface; and a developer roll for applying developer material from the developer housing to the charge-retentive surface.

9. The apparatus of claim 8, wherein the developer roll is a magnetic roll.

10. The apparatus of claim 4, wherein the developer material is two-component developer material.

11. A method of providing a first printing apparatus and a second printing apparatus, the first printing apparatus having a first developer unit and the second printing apparatus having a second developer unit, the first developer unit and the second developer unit having a substantially similar design and each defining an exit port for passage of excess or waste developer material therefrom, comprising:

installing in the first developer unit an insert of a first type, the insert of the first type defining at least one of a first predetermined barrier height and a first predetermined exit surface angle for developer material passing through the exit port thereof; installing in the second developer unit an insert of a second type, the insert of the second type defining at least one of a second predetermined barrier height and a second predetermined exit surface angle for developer material passing through the exit port thereof;

operating the first developer unit at a first speed; and operating the second developer unit at a second speed.

12. The method of claim 11, further comprising operating the first developer unit using a developer composition of a first type; and operating the second developer unit using a developer composition of a second type.

13. The method of claim 12, wherein the developer composition of the first type includes a chemical toner.

14. The method of claim 11, each of the first developer unit and second developer unit further comprising a rotatable member disposed within the developer unit, substantially adjacent the exit port.

15. The method of claim 14, wherein the rotatable member is an auger.

16. The method of claim 14, wherein the rotatable member rotates in a first rotational direction in the first developer unit and rotates in a second rotational direction in the second developer unit.

17. The method of claim 11, each of the first developer unit and second developer unit further comprising a charge receptor defining a charge-retentive surface; and a developer roll for applying developer material from the developer unit to the charge-retentive surface.

* * * * *